United States Patent [19]

Kuehnl

[11] Patent Number: 4,718,141

[45] Date of Patent: Jan. 12, 1988

[54] CLEANING DEVICE

[76] Inventor: Carol C. Kuehnl, 3969 Loves Creek Dr., Howell, Mich. 48843

[21] Appl. No.: 7,281

[22] Filed: Jan. 27, 1987

[51] Int. Cl.[4] ..... A47L 9/06

[52] U.S. Cl. ..... 15/394; 15/210 A

[58] Field of Search ..... 15/394, 395, 210 A

[56] References Cited

U.S. PATENT DOCUMENTS

| | | | |
|---|---|---|---|
| 2,231,802 | 2/1941 | Diggs | 15/394 |
| 2,271,694 | 2/1942 | Johnson | 15/394 |
| 2,490,892 | 12/1949 | Westhoff | 15/394 |
| 2,611,917 | 9/1952 | Ventsias et al. | 15/394 |

*Primary Examiner*—Chris K. Moore

*Attorney, Agent, or Firm*—Bertram F. Claeboe

[57] ABSTRACT

A cleaning tool is provided which has especial utility in the cleaning of Venetian blinds. The tool incorporates a plurality of elongated protuberances supported by manifold structure communicating with a vacuum source, the protuberances preferably taking the form of tubular support members having one or more axial rows of diametrically opposed air flow holes or openings therein and being essentially entirely wrapped or encased by an air permeable pile sleeve member. The tool of this invention effects an orderly thorough removal of dust and like particulate materials from the slats of Venetian blinds and other louvered structures.

2 Claims, 5 Drawing Figures

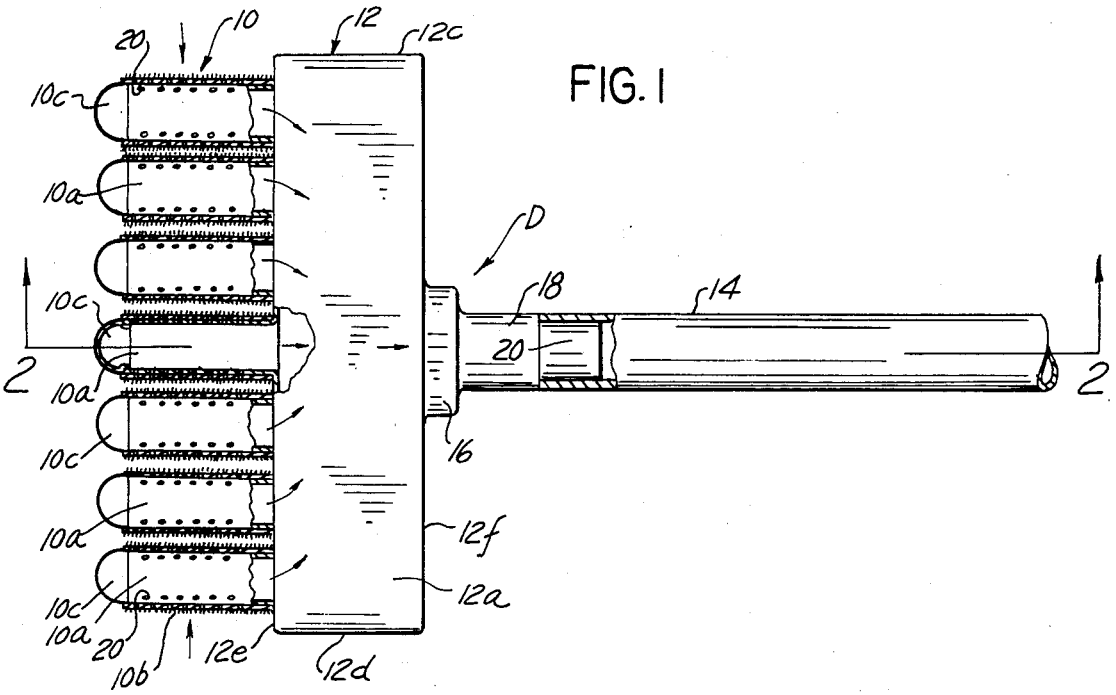
FIG. 1
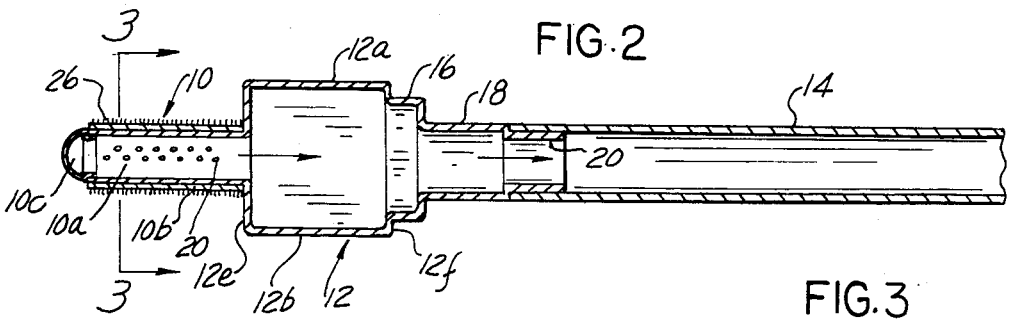
FIG. 2
FIG. 3
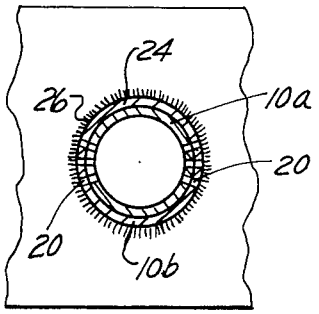
FIG. 4
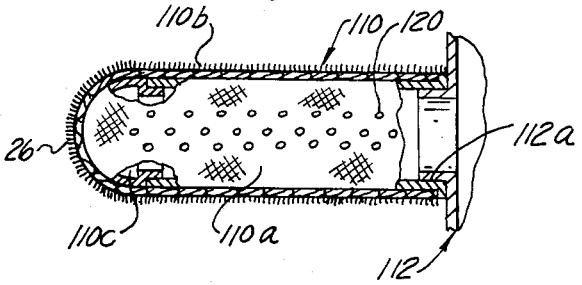
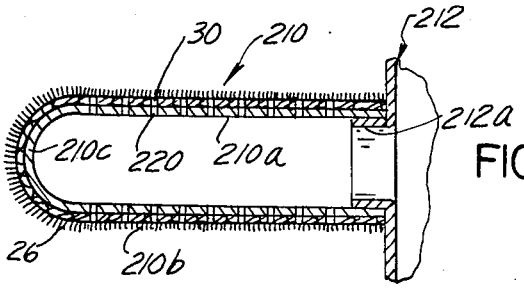
FIG. 5

CLEANING DEVICE

BACKGROUND OF THE INVENTION

It is known in the art to which this invention pertains to provide vacuum-assisted tools for the purpose of effecting the removal of dust and like particulate materials from the exposed surfaces of the slats in Venetian blind structures. Generally stated, in the earlier arrangements of which applicant is presently aware, the cleaning means, typically referenced to in the prior art as dusting, brushing or wiping elements, are provided by brushes or bristles, foamed plastic or multi-cellular pads or sponges, or tufts of string or yarn presenting generally the appearance of a conventional dust mop. Numerous drawbacks are immediately apparent in these earlier attempts at dust removal from the Venetian blind slats. The brush or tuft-type cleaning elements often act too vigorously upon the accumulated dust particles, creating what may be considered dust clouds in the immediate area, which tend to escape the collecting action of the suction forces provided by the main vacuum machine. As to the cellular pad or sponge cleaning element approach, the accumulated dust particles are generally not sufficiently disturbed, and there merely takes place a wiping action and little dust actually removed even with vacuum assistance.

The prior art structures suffer from an additional significant disadvantage. Earlier tools for cleaning Venetian blinds are generally characterized by a tubular nozzle portion mounting in various ways the cleaning elements. In some arrangements means are provided to trap the removal dust at one end of the nozzle, and in others along the length of the nozzle a single axially extending slot is provided. Again, it is apparent that effective dust removal cannot be anticipated utilizing conventionally available vacuum sources.

SUMMARY OF THE INVENTION

These and other disadvantageous characteristics of the prior art Venetian blind cleaning devices are effectively avoided by provision of a novel vacuum-assisted cleaning tool or device for the purposes herein disclosed, featuring in part as an active member thereof an air permeable pile sleeve embracing or mounted upon a tubular member having a plurality of axially disposed or axially extending rows of diametrically opposed holes or openings therein. The term "pile" as referred to herein designates a surface of unusually short close fine furry hairs, or as otherwise defined, a surface provided by short length, soft texture, fine diameter, and densely-arranged or close-textured fibers. In this manner, in combination with the novel tubular member of this invention, effective dust removal is assured.

BRIEF DESCRIPTION OF THE DRAWINGS

FIG. 1 is a perspective view, taken partially in section, showing the cleaning device of this invention;

FIG. 2 is a vertical sectional view taken substantially along the line 2—2 of FIG. 1;

FIG. 3 is a fragmented sectional view taken substantially along the line 3—3 of FIG. 2; and FIGS. 4 and 5 are sectional views illustrating modified forms of cleaning members embodying the novel concepts of the present invention.

DESCRIPTION OF THE PREFERRED EMBODIMENT

Referring now first to FIGS. 1 and 2 of the drawings, there is shown cleaning apparatus or device designated generally by the legend D. The cleaning tool or device D of this invention has especial utility in the cleaning of Venetian blind slots, and for this purpose is constructed to include a plurality of elongated cleaning members 10 connected to a manifold member 12 joined to conduit means 14 in communication with a suitable vacuum source (not shown), which may be provided by a conventional vacuum cleaner of the domestic or commercial variety.

The manifold member 12 may be of generally rectangular configuration having opposed side walls **12*a* and 12*b* connected to opposed end walls 12*c* and 12*d* joined to top and bottom walls 12*e* and 12*f*, respectively. The bottom wall 12*e* of the manifold member 12 is providing generally centrally thereof with a collar portion 16 joined to a neck portion 18 terminating in a head portion 20 frictionally engageable with collar member 14**. A snap-fit or generally similar connection may be used to effect the engagement noted.

In the embodiment of the invention shown in FIGS. 1 and 2, the cleaning members 10 and manifold member 12 are of unitary construction, desirably having been shaped or otherwise formed in a single manufacturing operation. As appears in these views, each cleaning member 10 is comprised of a perforated support member **10*a* wrapped by a removable air-permeable sleeve member 10*b* and mounting at its top end a generally conical guide member 10*c*. The cleaning members 10 are spaced from one another along top wall 12*e* of the manifold member 12 a distance sufficient to make effective wiping or rubbing action upon the opposed surfaces of the blind slats, and preferably a plurality of spaced rows of cleaning members 10 are provided across the width of the manifold member 12 between the side walls 12*a* and 12*b* thereof. While the perforated support members 10*a* and manifold member 12** are cross-hatched to denote metal, either or both of these parts may be fabricated of plastics and may be formed integrally if desired by injection molding techniques.

With reference now also to FIG. 3 of the drawings, each tubular support member **10*a* is provided along the axially length thereof with a plurality of relatively small diameter holes or openings 22 at diametrically opposed locations. A pair of rows of openings 22 spaced from one another along the circumference of each tubular member 10 is generally adequate for effective air flow through the air-permeable sleeve member 10*b*, however, it is also of significance for the same purpose that each row of openings 22** have its general counterpart diametrically opposite upon the tube circumference. This will be more fully explained hereinafter.

Each sleeve member **10*b* which wraps or surrounds each perforated support member 10*a* is air-permeable in order that dust or other particulate materials dislodged from the slat surfaces may pass freely under vacuum forces through the openings 22 in the support members 10*a* into the manifold 12 and through the conduit means 14 to a dust repository (not shown). A preferred material for the sleeve members 10*b*** is pile, which may be defined as a surface of usually short, close fine furry hairs, or as an alternative definition, a surface having a soft texture and comprised of short length, fine diameter, and densely arranged or closely-textured fibers. A material conforming to these definitions may be regarded as being fuzzy to the touch, and produces in the combination herein described a gentle cleaning action later to be more specifically explained.

Each sleeve member 10b may be preformed to a semi-rigid tubular shape, and as is best shown in FIG. 3, is preferably comprised of an air-permeable tubular support portion 24 and a multiplicity of fibers 26 adherent thereto. The composition providing the backing or tubular support portion 24 may of course be varied, and the particular fiber employed may be natural or synthetic or blends thereof.

In order to facilitate the ready insertion or proper positioning of the cleaning members 10 between the slats of a Venetian blind prior to initiation of the dust removal operation, each cleaning member 10 may include guide means 10c earlier noted. Such means may take the form of a generally conical or domeshaped cap of metal or plastic in threadable or snap-fitting engagement with the tip or outer end of each perforated support member 10a. If desired, the guide means 10c may be provided with holes or openings therein (not shown), and the sleeve member 10b may be so formed as to wrap or cover each guide member 10a.

Modified forms of the invention are shown in FIGS. 4 and 5, and reference is now made thereto. In the structural arrangement of FIG. 4, cleaning members 110 are detachably associated with manifold member 112. For this purpose the manifold member 112 is shaped to include collar or neck portion 112a in threadable or snap-fit engagement with the base of perforated support member 110a. In other respects the embodiment of FIG. 4 is like that of FIGS. 1 to 3, and accordingly like numerals have been applied raised by the integer "100."

In the inventive embodiment of FIG. 5, the sleeve member and support member both have air holes or openings therein which register or are in alignment. More specifically, cleaning members 210 include a support member 210a provided with holes or openings 220 therein arranged in the manner of the form of the invention of FIGS. 1 to 3, the holes or openings 220 registering or being aligned with holes or openings 30 in sleeve member 210b. Manifold member 212 may be configured in the manner of FIG. 4, and accordingly, has a neck or collar portion 212a in snap-fit or threadable association with base of support member 210a. The sleeve member 210b in FIG. 5 preferably is preformed to substantially totally encase or surround the support member 210a, including guide member 210c thereon.

The operation of the cleaning tool or device D of the present invention may be described as follows. While the embodiments of the invention portrayed in FIGS. 4 and 5 incorporate structural variations in the cleaning apparatus of FIGS. 1, 2 and 3, the mode of operation of applicant's contribution to the art is generally common to all forms of cleaning members 10, 110 and 210.

Upon actuation of a suitable vacuum source, either prior to or after insertion of the cleaning members 10, 110 or 210 between the blind slats, the tool or device D is moved generally horizontally with firm but gentle strokes with the pile sleeve member 10b, 110b or 210b in sweeping or wiping contact with the particles of dust or other unwanted particulate materials accumulated on the opposed slat surfaces. By reason particularly of the short length, soft texture, fine diameter and dense arrangement of the fibrous surface presented by the pile sleeve members, the dust particles ar gently raised or lifted and immediately removed from the slat surfaces, rather than vigorously swept into a condition of disarray or cloud-like form, as has characterized certain prior art structures.

Essentially simultaneously by this invention the disturbed dust particles are acted upon by vacuum forces exerted through the novel arrangement of holes or openings 20, 120 or 220 in the support members 10a, 110a or 210a, respectively. As noted earlier, the relatively small diameter holes or openings in each support member are arranged in a plurality of rows extending axially along a major portion of the length of each support member, and also are provided at diametrically opposed locations upon the circumference thereof. In this manner, immediately after being lifted or removed from the slat surfaces by the pile fibers, the dust or other particulate materials are drawn by the air-permeable or porous sleeve members 10b, 110b and 210b and through the holes or openings 20, 120 and 220 into the center interior of the support members 10a, 110a and 210a, respectively. The removed dust particles then pass through the manifold structure 12, 112 or 212 and into suitable collection means (not shown).

The tool or device D of this invention has been particularly described in connection with the cleaning of Venetian blinds of the vertical or horizontal type with wide or narrow slats. However, it is readily apparent that the novel concepts disclosed herein have application to other louvered structures having fins, shutters or slats in association therewith. These and other modifications may of course be practiced without departing from the spirit of the invention or the scope of the subjoined claims.

I claim:

1. A cleaning device for removing dust and like substances from both narrow and wide Venetian blind slats, comprising manifold means communicating with a source of negative pressure and being provided on one surface thereof with a plurality of closely spaced tubular protrusions, and a plurality of closely spaced tubular cleaning members supported upon said one surface of said manifold means and communicating with the interior thereof, each of said cleaning members including a tubular support member engageable at one end thereof with selected tubular protrusions for snap fitting securement thereto, each support member being apertured to provide a plurality of small diameter openings arranged in closely spaced relation along the longitudinal axis thereof, guide means connected to the opposite end of each of said tubular support members and shaped with a rounded dome-like leading surface for guiding the cleaning members into and within the Venetian blind slats, each of said cleaning members further including an air permeable pile sleeve member of sock-like configuration embracing each of said tubular support and guide means thereon in slidable tight-fitting enveloping relation therewith, each of said sleeve members, having a surface provided by a multiplicity of soft texture, short length, upright, fine diameter, and densely arranged fibers, each of said sleeve members being apertured to provide a plurality of small diameter openings arranged in closely spaced relationship along the longitudinal axis thereof and precisely located for registration with like openings in each of said support members, whereby when negative pressure is utilized dust and like substances on the Venetian blind slats are dislodged and sucked through the openings in said sleeve members and in said support members for passage into said manifold means, said support members being selectively removable from the protrusions on said manifold means depending upon the width of the Venetian blind slat being cleaned.

2. A tool for the removal of particulate materials from both narrow and wide Venetian blind slats, comprising means defining a manifold communicating with a source of negative pressure, and a plurality of closely spaced tubular cleaning members communicating with the interior of said manifold means and removably supported upon the exterior thereof for selective engagement or disengagement depending upon the width of the slat being cleaned, each of said cleaning members including a tubular support provided on the circumference thereof with a plurality of rows of diametrically opposed small diameter openings arranged in closely spaced relation along the longitudinal axis of each of said support members, each of said cleaning members further including an air permeable pile sleeve member removably embracing each of said support members and being effective under action of negative pressure to dislodge particulate materials from the Venetian blind slats into and through said openings in said support members and into said manifold means, each of said pile sleeve members being provided by a multiplicity of soft texture, short length, upright, fine diameter, and densely arranged fibers.

* * * * *